US011559158B2

(12) United States Patent
Cohn et al.

(10) Patent No.: US 11,559,158 B2
(45) **Date of Patent: *Jan. 24, 2023**

(54) ARTICLE HANGING DEVICE

(71) Applicant: Sheldon Cohn, West Bloomfield, MI (US)

(72) Inventors: Sheldon Cohn, West Bloomfield, MI (US); Justin Micheal Morelock, Detroit, MI (US); Kirt Bennett, Lake Orion, MI (US)

(73) Assignee: Sheldon Cohn, West Bloomfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/509,232

(22) Filed: Oct. 25, 2021

(65) Prior Publication Data

US 2022/0039577 A1 Feb. 10, 2022

Related U.S. Application Data

(63) Continuation of application No. 16/315,892, filed as application No. PCT/US2017/041015 on Jul. 7, 2017, now Pat. No. 11,154,150.

(Continued)

(51) Int. Cl.

*A47G 25/06* (2006.01)
*A47B 61/02* (2006.01)

(Continued)

(52) U.S. Cl.

CPC ..... *A47G 25/0685* (2013.01); *A47B 61/02* (2013.01); *A47F 7/19* (2013.01); *D06F 57/04* (2013.01)

(58) Field of Classification Search

CPC ..... A47G 25/0685; A47B 61/02; A47F 7/19; D06F 57/04

See application file for complete search history.

(56) References Cited

U.S. PATENT DOCUMENTS 40,936 A 12/1863 Horn
176,814 A 5/1876 Rusby (Continued)

FOREIGN PATENT DOCUMENTS

CH 143967 A 12/1930
CH 250880 A 9/1947

(Continued)

OTHER PUBLICATIONS

International Search Report and Written Opinion for International Application No. PCT/US2017/041015, dated Oct. 18, 2017.

*Primary Examiner* — Stanton L Krycinski

(74) *Attorney, Agent, or Firm* — The Dobrusin Law Firm, P.C.

(57) ABSTRACT

An article hanging device including a hub having a first side and an opposing second side, the first side having a plurality of openings; and a plurality of arms, each arm having a body portion located between a proximal end and a distal end. The distal end of each arm is received within one of the openings of the hub and wherein the arm is in pivoting relation to the openings. The plurality of arms are adapted to support one or more articles. One or more attachments may be secured to the arms, such as one or more hooks, upon which the one or more articles may hang.

20 Claims, 10 Drawing Sheets

Related U.S. Application Data

(60) Provisional application No. 62/359,976, filed on Jul. 8, 2016.

(51) Int. Cl.
*D06F 57/04* (2006.01)
*A47F 7/19* (2006.01)

(56) References Cited

U.S. PATENT DOCUMENTS

| | | | | |
|---|---|---|---|---|
| 330,159 | A | | 11/1885 | Sharp |
| 342,954 | A | | 6/1886 | Ertell |
| 361,154 | A | | 4/1887 | Finnegan |
| 424,569 | A | | 4/1890 | Morrison |
| 441,562 | A | | 11/1890 | Holt |
| 618,999 | A | | 2/1899 | Sayer |
| 681,397 | A | | 8/1901 | Junker |
| 723,114 | A | | 3/1903 | Witt |
| 765,719 | A | | 7/1904 | Steffens |
| 797,614 | A | | 8/1905 | Schipkowsky |
| 812,396 | A | | 2/1906 | Bewyer |
| 821,364 | A | | 5/1906 | Jessel |
| 858,159 | A | | 6/1907 | Deis |
| 937,155 | A | | 10/1909 | Krasne |
| 992,764 | A | | 5/1911 | Frederickson |
| 1,046,319 | A | | 12/1912 | Mohney |
| 1,113,169 | A | | 10/1914 | Kyllo |
| 1,236,169 | A | | 8/1917 | Henrnik |
| 1,326,059 | A | | 12/1919 | Humphrey |
| 1,400,359 | A | | 12/1921 | Hagerman |
| 1,476,667 | A | | 11/1922 | Wood |
| 1,530,407 | A | | 12/1923 | Ranson |
| 1,563,137 | A | | 4/1924 | Amsler |
| 1,587,676 | A | | 6/1926 | Patterson |
| 1,697,866 | A | | 1/1929 | Hansen |
| 1,713,673 | A | | 5/1929 | Nelson |
| 1,896,654 | A | | 1/1931 | Weaton |
| 1,933,981 | A | | 10/1932 | Householder |
| 1,937,911 | A | | 10/1932 | Pajeau |
| 1,951,979 | A | | 12/1932 | Hoffmire |
| 2,022,712 | A | | 8/1934 | Firle |
| 2,217,795 | A | | 1/1938 | Dawson et al. |
| 2,177,084 | A | | 3/1939 | Thomsom |
| 2,434,242 | A | | 3/1945 | Hermes |
| 2,401,969 | A | | 7/1945 | Schlank |
| 2,618,392 | A | | 5/1951 | Keutzer |
| 2,613,931 | A | | 10/1952 | Singer |
| 2,797,817 | A | | 4/1955 | Shugarman |
| 2,987,193 | A | | 6/1961 | Pajor |
| 3,788,489 | A | | 1/1974 | Levinthal |
| 3,857,493 | A | | 12/1974 | Bourne |
| 4,856,661 | A | * | 8/1989 | Guillen ..... A47G 25/0685 211/100 |
| 5,405,065 | A | | 4/1995 | Olson |
| 5,458,249 | A | | 10/1995 | Shang-Lu |
| 7,147,116 | B1 | | 12/2006 | Cape |
| 7,237,687 | B1 | | 7/2007 | Abdi et al. |
| 7,445,127 | B2 | | 11/2008 | Pittman |
| 7,451,882 | B2 | | 11/2008 | McKay |
| 7,878,379 | B2 | | 2/2011 | Murphy, Jr. |
| 8,602,228 | B1 | | 12/2013 | Martinez |
| 9,909,250 | B1 | | 3/2018 | Greenspon et al. |
| 2011/0089127 | A1 | * | 4/2011 | Thomas ..... A47F 5/02 211/183 |

FOREIGN PATENT DOCUMENTS

| | | | | |
|---|---|---|---|---|
| DE | 9307919 | U1 | | 10/1994 |
| FR | 436533 | A | | 3/1912 |
| GB | 139127 | A | | 2/1920 |
| GB | 181864 | A | | 6/1922 |
| GB | 211259 | A | | 2/1924 |
| GB | 215652 | A | | 5/1924 |
| GB | 273196 | A | * | 6/1927 |
| GB | 277136 | A | | 9/1927 |
| GB | 286049 | A | | 3/1928 |
| GB | 444332 | A | | 3/1936 |
| GB | 692044 | A | | 5/1953 |
| GB | 944698 | A | | 12/1963 |
| GB | 1020844 | A | | 2/1966 |

* cited by examiner

ARTICLE HANGING DEVICE

CLAIM OF BENEFIT OF FILING DATE

The present application claims the benefit of the filing date of U.S. application Ser. No. 62/359,976, filed on Jul. 8, 2016, the contents of which are expressly incorporated by reference.

FIELD

In general, the present teachings relate to an article hanging device. More particularly, the present teachings pertain to a hub and a plurality of arms extending therefrom adapted for supporting articles, such as clothing.

BACKGROUND

Consumers generally have a large collection of clothing, such as shirts, pants, sweaters, jackets, and other items or accessories, such as bags, purses, neckties, jewelry, belts, scarves, and the like. When these garments and other items are not being worn, they must be stored. To store these garments and other items, consumers use a variety of means.

Garments and other items, such as bags or purses, can be placed on hooks or projections of a coat rack. However, traditional coat racks do not have room for many items. This often leads to garments and other items being piled on top of each other, which makes it difficult to find a desired article. Also, the garments have a tendency to fall off of the coat rack, especially when too many articles are placed on one hook or projection or when a person is searching for an item located somewhere on the rack.

Closets are often used for storing garments and other belongings, and they typically have one or more rods upon which the garments can be hung via a hanger. However, hangers can cause damage to certain articles of clothing or can produce unsightly bumps on a shirt's shoulder. Many people often accumulate a large number of hangers, such as after dry cleaning garments, and these hangers become wasted or are even thrown away, leading to additional waste in landfills. In addition, when many garments are packed into the closet, it is difficult to see and access each garment. Often, closets are not large enough, or there is insufficient hanging space, to accommodate all of the garments or other articles, which leads to items being placed on the floor, or jammed into any available opening, which may cause damage or excessive wrinkling.

In addition, many people do not have sufficient space in other areas of the house for their garments, such as laundry roams, and when garments must be hung (e.g., to air dry) or after being removed from the dryer to avoid wrinkles from throwing the garments into a laundry basket, there is often not enough space for these garments.

As it takes greater time and effort to hang garments or put them in a proper place, many people resort to faster alternatives—making piles of the articles on the floor, on a chair, or in a basket, for example. This makes it difficult to differentiate between clean and dirty garments, and also leads to wrinkling of the garments. It can also cause damage to the garments or other items. There are also many people who are unable to hang their clothes. For example, elderly people or young children may lack the dexterity to secure an article to a hanger and then hang the hanger in a closet. Also, children may not be able to reach the closet rod or shelves to put articles away or to get the articles out again.

Notwithstanding efforts to improve storing garments and other personal items, there remains a need for alternative assemblies, particularly those that provide more storage space, provide easier storage of garments and other items, provide easier accessibility to garments and other items, provide for customizable storage, and provide additional organization.

SUMMARY

The present teachings make use of a simple, yet elegant, construction approach by which relatively few components can be employed for hanging a plurality of articles easily and conveniently.

The teachings generally contemplate an article hanging device. The article hanging device may include a hub having a first side and an opposing second side. The first side, the second side, or both, may have a plurality of openings. The article hanging device may include a plurality of arms to be received within the plurality of openings in the hub. Each arm may have a body portion located between a proximal end and a distal end. The distal end of each arm may be received within one of the openings of the hub. The arm may be able to pivot or rotate within the openings so that the position of the arms may be adjusted. The plurality of arms may be adapted to support one or more articles.

The teachings also contemplate any or any combination of the following features. The article hanging device may include one or more attachments secured to at least one of the arms. The one or more articles may be adapted to be supported by the article hanging device via the one or more attachments. The one or more attachments may include a hook portion. The one or more attachments may generally form an S-shape. The one or more attachments may include a connector portion for securing the attachment to the arm. The one or more attachments may include a hook portion adapted for contacting the one or more articles supported by the article hanging device. The hook portion of one or more attachments may have a width that is greater than any other portion of the one or more attachments. The one or more attachments may be adapted to snap onto one of the arms of the article hanging device. One or more of the arms may include one or more grooves that extend along at least a portion of a length of the arm. The connector portion of the one or more attachments may include a lip that interfaces with the groove to secure the one or more attachments on the arms. The one or more attachments may include a frictional surface or a frictional coating in an area where the one or more articles are adapted to contact the one or more attachments. One arm may include two or more attachments secured thereto. The distal end of the one or more arms may be at an angle relative to the body portion. The hub may be adapted to be mounted to a structure (e.g., a wall) via one or more bracket structures. The hub may include a hollow portion (e.g., an opening for receiving a post, such as a central opening). The hub may be generally circular. The hub may be shaped to have one or more straight edges (e.g., rectangular, polygonal, semicircular). The plurality of openings in the hub for receiving the arms may be arranged at or near an entire perimeter of the hub. The plurality of openings in the hub may be arranged at or near only a portion of a perimeter of the hub. The article hanging device may include an upright post received within the hollow portion of the hub. The hub may be secured to the upright post at a desired position (e.g., a desired height). The article hanging device may include a base for stabilizing the article hanging device. The upright post may be secured to and/or extend from the base. The upright post may be mounted to a structure (e.g., a wall) via one or more bracket structures. The position of the hub (e.g., height) on the upright post may be adjusted. The article hanging device may include two or more hubs secured to the upright post (e.g., to create a multi-level article hanging device). The article hanging device may be secured to and/or hung from a horizontal rod (e.g., a closet rod) via a rod attachment structure. The one or more articles to be hung from the hanging device may include one or more garments.

As can be seen, it is thus possible to realize a unique assembly (and associated methods) that enables a person to easily hang a plurality of articles and that enables a person to customize and adjust the device based on a user's desires and needs. The assembly also allows garments to be hung without the use of a tradition clothes hanger.

DETAILED DESCRIPTION

Figure 1:
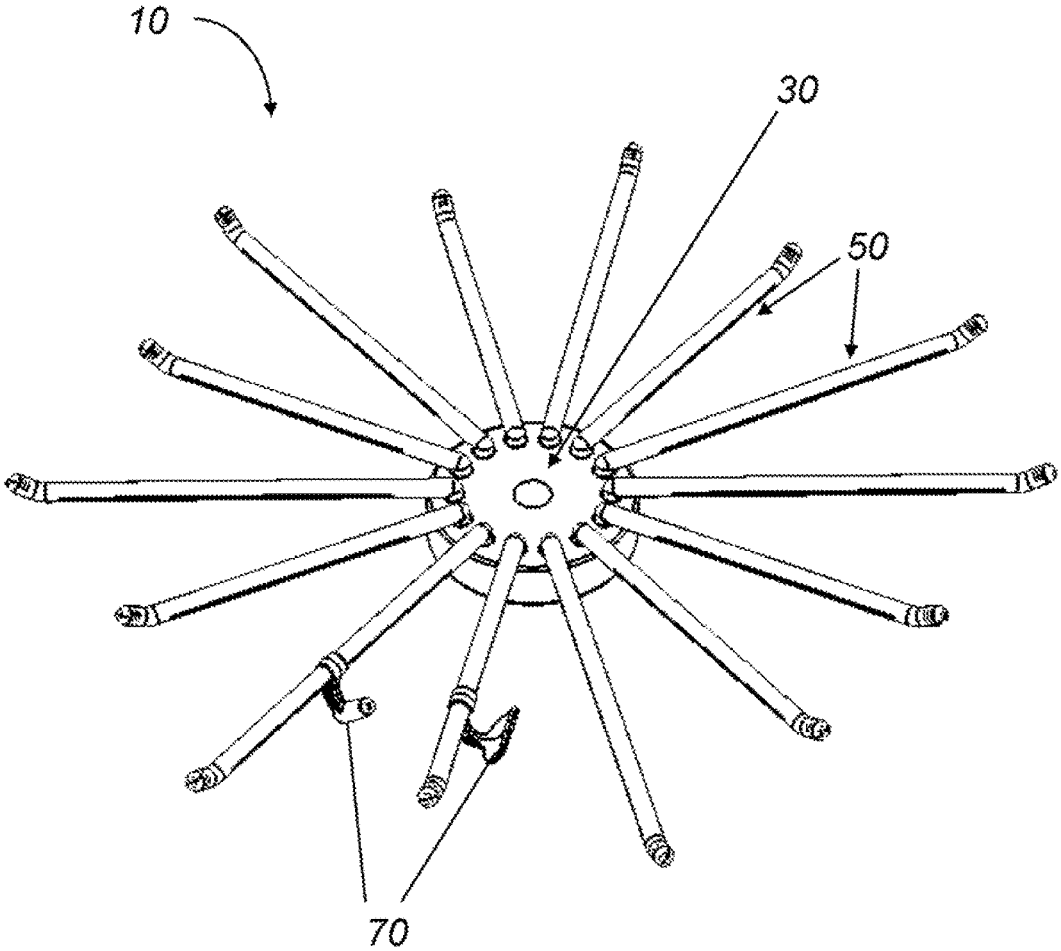
FIG. 1 is a top perspective view of an article hanging device in accordance with the present teachings.

As required, detailed embodiments of the present teachings are disclosed herein; however, it is to be understood that the disclosed embodiments are merely exemplary of the teachings that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present teachings.

In a very general sense, the teachings herein relate to an improved assembly by which articles, such as garments, may be hung. The teachings relate to an article hanging device including a hub with arms extending therefrom, with the arms adapted for supporting the articles such as garments. The arms may include one or more attachments, such as hooks, from which the articles can hang.

The article hanging device of the present teachings may be used in a variety of settings. The following settings and uses are for exemplary purposes only and not to serve as limiting. The article hanging device may be used in a home, and may be positioned in a closet, against a wall, mounted to a wall, in a corner, mounted in a corner, or anywhere in a room. The article hanging device may be useful in laundry rooms where garments must be hung to dry or to avoid wrinkles after being removed from the dryer. The article hanging device may be useful in a bathroom or around a pool for hanging towels. The article hanging device may be used in retirement homes or daycares, where the users may not have the dexterity to put a garment or other article on a traditional clothes hanger but still want to organize their garments or other articles. The article hanging device may be used in a classroom for hanging students' winter coats. The article hanging device may be used in a store where easy access to garments is desired and/or where it is desired that the garments be visible and presented in a unique and organized way. The article hanging device may be used by dry cleaners rather than using traditional hangers.

As is seen, the article hanging device of the present teachings has many applications, and it is contemplated that the article hanging device can be customized in a variety of ways depending on the user's needs. Again, for exemplary purposes only and not to serve as limiting, the following are possible customizations for the article hanging device. The height, size, and shape of a hub can be customized. The number of arms and the length of the arms can be customized. The number of attachments and the types of attachments on each arm can be customized. The installation of the article hanging device can be customized. For example, the article hanging device may be secured to a post, may be mounted to a wall, may be hung from a horizontal rod, or a combination thereof.

The present teachings include a hub which functions to receive and/or support a plurality of arms. The hub may have a first side and an opposing second side. The hub may include a plurality of openings for receiving at least a portion of the arms. The openings may extend through the entire thickness of the hub (e.g., forming hollow channels). The openings may extend only partially through the hub. The openings may be on the first side, the second side, or both. The size and/or shape of the openings may depend upon the size and/or shape of the arm that is received therein. For example, the openings may be generally circular and may receive the proximal end of an arm with a generally snug fit so that the arm is secured within the opening. The openings may be positioned near the outer edge of the hub so that the arms may extend outwardly past the hub. As the arms may be permitted to pivot within the openings, the openings may include one or more features for facilitating the pivoting, such as one or more bearings.

The hub may also include an opening for receiving a post or other support structure. The opening may be generally centrally located. The hub may be secured to the post to allow the hub (and arms) to be elevated to accommodate articles hanging therefrom. The hub may include one or more (e.g., a plurality of) fastener apertures for receiving a fastener. The fasteners may permit the hub to be attached, for example, to a bracket structure or a post attachment structure.

The first side, the second side, or both, may be generally planar. The first side, the second side, or both, may have one or more curves or curved portions. For example, the first side, the second side, or both, may be a generally circular shape. The first side, the second side, or both, may have an elliptical or ovular shape. The first side, the second side, or both, may have one or more generally straight edges. For example, the first side, the second side, or both, may have a semicircular or partial circle shape (e.g., when viewed from the top, the bottom, or both). The first side, the second side, or both, may have a plurality of generally straight segments to form a polygonal shape. In its longest dimension (which may be the diameter), the first side, the second side, or both, may have a length of about 10 cm or more, about 15 cm or more, or about 20 cm or more. The first side, the second side, or both, may have a length of about 35 cm or less, about 30 cm or less, or about 25 cm or less.

The hub has a thickness, where the thickness is measured from the first side to the second side. The thickness of the hub may be about 1.25 cm or more, about 2.5 cm or more, about 3.75 cm or more, or about 5 cm or more. The thickness of the hub may be about 12.75 cm or less, about 10.25 cm or less, 7.5 cm or less, or about 6.25 cm or less. The hub may be generally cylindrical.

The hub may be generally solid. The hub may be generally hollow or may have one or more hollow portions. The hub may be formed of any material capable of receiving and supporting a plurality of arms and articles hanging therefrom. The hub may be made of wood, plastic, metal, metal alloys, or a combination thereof. The article hanging device may include more than one hub (e.g., two or more hubs) to provide varying levels of article hanging. For example, a hub could be located on a post, and another hub could be located on the same post below the first hub to provide a dual-level article hanging device.

The article hanging device includes one or more arms, and preferably a plurality of arms, for supporting one or more articles and/or one or more attachments. At least a portion of the arms may be adapted to be received within the openings of the hub or otherwise supported by the hub. The arms may be removable from the openings of the hub (e.g., to permit customization of types or lengths of arms, to reposition the arm in another opening, to provide arms only in certain openings, and the like). The arms may extend outwardly (e.g., radially) from the hub to allow one or more articles to be attached thereto or hung therefrom. The arm may include a proximal end, a distal end, and a body portion therebetween.

Between the body portion and the proximal end may be a proximal segment. The body portion and the proximal segment may be in angular relation to each other. The body portion and the proximal segment may form an angle of about 75 degrees or more, about 80 degrees or more, or about 85 degrees or more. The body portion and the proximal segment may form an angle of about 120 degrees or less, about 110 degrees or less, or about 100 degrees or less. For example, the body portion and the proximal segment may form an angle of about 90 degrees. The proximal end may be adapted to be received within an opening of the hub. At least a portion of the proximal segment may also be received within the opening of the hub. The body portion may then extend away from the hub and the proximal segment.

Between the body portion and the distal end may be a distal segment. The body portion and the distal segment may be in angular relation to each other. The body portion and the distal segment may form an angle of about 80 degrees or more, about 100 degrees or more, or about 120 degrees or more. The body portion and the distal segment may form an angle of about 180 degrees or less, about 160 degrees or less, or about 140 degrees or less. The distal segment may be generally upturned so that one or more articles are permitted to hang from the distal end of the arm without sliding off.

The distal end may have a cap. The cap may provide a smooth surface at which the arm terminates. The cap may provide additional frictional material to hold an article in place and/or to prevent an article from sliding off of the end. The cap may be generally elastomeric and may be at least partially received within the hollow end of the arm. The distal end may instead include a hook, a loop, a clip, or other member to permit an article to be hung from the end.

The body portion of the arm may function to provide an area to support one or more articles and/or one or more attachments for hanging articles. The body portion may be generally straight (e.g., when viewed from the side). The body portion may include one or more surface features for securing an attachment to the arms. The surface features may include, but are not limited to, grooves, indentations, holes, slots, projections, bumps, ridges, or the like. These surface features may engage with one or more features of an attachment (e.g., a lip of the attachment received within a groove of the body portion). The attachment may then be permitted to slide along the length of the surface feature (e.g., along the entire length of a groove in the body portion). The one or more surface features may extend along all or a part of the length of the body portion (e.g., about 50 percent or more, about 70 percent or more, or about 90 percent or more of the length of the body portion). The body portion may include two or more surface features. For example, a groove may be located on one side of the arm and another groove may be located on an opposing side of the arm. The multiple and/or opposing surface features may permit an attachment to be positioned on the arm to face in more than one direction. For example, a lip of an attachment may engage with one groove, and a lip of another attachment may engage with an opposing groove so that the attachments face opposite directions.

One or more of the arms may be permitted to pivot relative to another arm and/or relative to the hub. For example, the arm (e.g., the proximal end) may be permitted to rotate within the opening to allow the arm to move. An angle formed between one arm and an adjacent arm may be adjusted due to the ability of the arm to rotate within the opening of the hub. Therefore, the distal ends of the arms may be permitted to contact each other (or nearly contact each other). The distal ends of the arms may be pushed away from each other to provide an angle of about 180 degrees or more. Any angle in between is also contemplated.

The arms may be formed from any material that is capable of supporting one or more articles. For example, the arm may be formed from metal or metal alloys (e.g., steel such as mild steel or stainless steel), plastic, or wood. The arms may be any length that is capable of supporting one or more articles (e.g., without bending). The arms of the article hanging device may have varying lengths. For example, some arms may extend further from the hub than other (e.g., adjacent) arms. The varying lengths may permit customization of the article hanging device.

The article hanging device may include one or more (e.g., a plurality of) attachments that are secured to one or more arms for hanging one or more articles. An attachment may include a connector portion that allows the attachment to be connected to an arm of the article hanging device. The attachment may also include an article contact portion that is adapted to contact a portion of an article so the article can be supported and/or hung from the arm. The present teachings also contemplate a plurality of attachments on each arm.

The connector portion of the attachment may permit a snap fit of the attachment onto the arm. The connector portion may have an inner surface that generally matches the contours of the surface (e.g., of the arm) to which it is being attached. For example, an arm may have a generally tubular body portion (e.g., a generally circular cross-section). The connector portion may be shaped to be generally semicircular so that the connector portion may snap on and be secured to the outer diameter of the body portion of the arm.

The connector portion may have one or more engagement structures for engaging with a groove or other surface feature of the arm. For example, the connector portion may include a lip. The lip (or other engagement structure) may function to secure the attachment to the arm, to ease installation of the attachment to an arm (e.g., by allowing the attachment to be snapped into place), to prevent rotation of the attachment around the arm (e.g., when the attachment is supporting the weight of an article), to permit adjustability of the attachment (e.g., to allow the attachment to slide along the length of the arm during adjustment), or a combination thereof. For example, the connector portion may have a lip located at the end of the connector portion that engages with a groove on the side of the arm when the attachment is snapped on to the arm. The attachment may be permitted to slide along the length of the arm (e.g., along the groove of the arm) when a force is applied so that the attachment may be positioned in a desired location along the length of the arm without having to remove the attachment. When the arm has a projecting surface feature, such as a ridge, the connector portion may include an indented area or a groove for interfacing, with the projecting surface feature of an arm to hold the attachment in place on the arm.

The attachments may each include an article contact portion, which functions to contact and/or support one or more articles. The article contact portions may include a frictional surface or a frictional coating (e.g., a textured surface or a surface having an elastomeric or tacky material or coating) to reduce the likelihood of an article slipping from the article contact portion. The article contact portion of one or more attachments may include a hook portion for supporting an article, and for allowing an article to be hung therefrom. The attachment may have an S-shape so that the attachment can be secured to an arm at the connector portion and the hook portion extends toward the opposing direction. The hook portion may terminate at a tip. The tip may have a frictional portion (e.g., an elastomeric cap or coating) for reducing the likelihood of an article slipping from the article contact portion. The attachment may include a wide article contact portion to distribute the contact between the attachment and the article over a greater area. This may help to distribute the pressure on the article (e.g., due to the weight of the article hanging from the attachment), which may further support the article on the attachment and/or allow heavier articles to be hung from the attachment and article hanging device. The width of the article contact portion may be about 2.5 cm or greater, about 5 cm or greater, or about 6 cm or greater. The width of the article contact portion may be about 10 cm or less, about 8 cm or less, or about 6.5 cm or less.

A variety of other attachments are contemplated. The article contact portion may include a loop. The loop may be helpful for holding belts, scarves, jewelry, and the like, for example. The article contact portion may include a clamping member, such as a clothespin member, for gripping an article. The article contact portion may include more than one hook portion. The article contact portion may include a friction member that is secured over a length of an arm, which may include a frictional surface, such as a coating or other material layer for providing additional friction. Such a friction member may be helpful, for example, for draping pants, towels, or other garments over an arm of the article hanging device. An attachment having a generally planar portion may contact two or more arms (e.g., to connect two or more arms), such as to provide a shelf or flat surface to put folded garments or other articles, such as shoes.

The attachments may be used in any combination. Multiple attachments, which may be the same or different, can be used in the same article hanging device. Multiple attachments, that are the same or different, can be used on the same arm of the article hanging device. The attachments may be constructed of any material capable of supporting an article and capable of attaching to an arm. The attachments may be formed from polymeric materials (e.g., polypropylene, thermoplastic elastomers), metal or metal alloys, wood, or a combination thereof for example.

The article hanging device may include a post upon which the hub may be secured. The post may be a support structure (e.g., generally cylindrical) received within an opening (e.g., a central opening) of the hub. The post may be formed from one or more pieces. For example, the post may be a single pole. The post may include two or more pieces or segments that can be assembled to form a post, which may provide for easier packaging or shipping. For example, the two or more pieces may include a male portion and a female portion that may be joined (e.g., via threaded engagement) to assemble the post. The post may have one or more telescoping portions (e.g., so that the height of the post can be adjusted or so that the post can be collapsed for easier storage or shipping). The post may be any height and any size capable of supporting a hub, a plurality of arms, and/or a plurality of articles hanging therefrom. The post may have a generally circular cross-section. The post may have a cross section having one or more curved portions (e.g., an ovular cross-section). The post may have one or more straight edges in the cross-section (e.g., a polygonal cross-section, or a semicircular cross-section). The post may be formed from any material(s) capable of supporting a hub, a plurality of arms, and/or a plurality of articles hanging therefrom. For example, the arm may be formed from metal or metal alloys (e.g., steel such as mild steel or stainless steel), plastic, or wood.

The article hanging device may include a post attachment structure that allows the hub to be secured to the post. The post attachment structure may allow the height of the hub to be adjusted on the post. The post attachment structure may include a hub interface portion that contacts the hub and/or is attached to the hub. The hub interface portion may be generally planar to be positioned against a portion of the hub (e.g., a portion of the first side or a portion of the second side). The hub interface portion may include one or more fastener apertures for receiving a fastener to secure the post attachment structure to the hub. Alternatively, the post attachment structure may be integrally formed with the hub. The post attachment structure may include a hollow portion that aligns with the opening of the hub (e.g., the central opening) so that the post may be received within both the opening of the hub and the hollow portion of the post attachment structure. The post attachment structure may include a means for securing the hub to the post. For example, the hollow portion of the post attachment structure may have one or more openings for receiving a fastener. The hollow portion may include one or more position securing openings, which may be one or more openings (e.g., threaded openings) for receiving a fastener, like a threaded fastener such as a bolt. The bolt may be tightened within position securing opening so that the end of the bolt contacts the post and the hub is therefore adjustably secured to the post. The post may include one or more openings for receiving the bolt or for receiving a pin or other fastener. The post attachment structure may alternatively include a clamping mechanism so that the post attachment structure may be clamped onto the post (e.g., by actuating with a lever). Alternatively, the post may include one or more spring loaded pins or buttons that engage with an opening in the hollow portion of the post attachment structure to secure the post attachment structure to the post.

The post may be supported by and/or attached to a base structure. The base may be positioned on a flat surface, such as a floor or a table, and the post may extend upwardly therefrom. The base may function to support the post of the article hanging device. The base may provide stability to the article hanging device. The base may include a post attachment area, which may include an opening for receiving a fastener to attach the base to the post. The base may include a hollow portion or a tubular member extending therefrom that is adapted to receive the post. The base may include a peg or other projection upon which a hollow post may be situated. The base may include a threaded tubular member or threaded projection to threadingly engage optional threads on the outer or inner diameter at or near an end of the post.

The base may be any shape and size capable of supporting the article hanging device and any articles hanging therefrom (e.g., without tipping over). For example, the base may have a generally circular shape. The base may have one or more straight edges. For example, the base may have a straight edge so that the article hanging device may be positioned on the floor and against a wall or other vertical structure. The base may have two or more straight edges, with the edges forming an angle of about 90 degrees, so that the article hanging device can be positioned in a corner (e.g., of a room or of a closet). The base may have a plurality of cutouts. The cutouts may help to reduce the weight of the base (e.g., so that the article hanging device may be moved easily, or so that the base is not too heavy for shipping). The cutouts may be in any pattern or design. The base may have more weight toward the outer edges of the base (e.g., by fewer or smaller cutouts or by additional weights) to reduce or prevent tipping of the article hanging device.

The underside of the base (i.e., the portion of the base that is facing the floor or other surface) may include one or more elements for elevating the base slightly off of the floor, providing protection and reducing scratching of the floors, helping to slide the article hanging device across the floor to position the article hanging device where desired (e.g., by reducing friction between the base and the floor), maintaining the article hanging device in a proper position (e.g., by increasing friction between the base and the floor), or a combination thereof. For example, the base may have one or more felt pads or one or more elastomeric pads on the underside. The base may include wheels on the underside of the base for easing movement of the article hanging device. The wheels may be locked (or even removed) when the article hanging device is in a desired location.

Rather than being supported by a base on the ground, the article hanging device may be suspended from the ground. One or more bracket structures may support the article hanging device and may attach the article hanging device to a structure, such as a wall. The one or more bracket structures may be attached directly to the hub. The hub may include one or more fastener apertures for receiving fasteners, such as screws, which may secure the bracket to the hub (or the hub to the bracket). A bracket structure may be generally L shaped. A bracket structure may support the hub underneath the hub. The bracket structure may have a wall attachment portion that is secured to the wall. The bracket structure may have a hub attachment portion that is attached to the hub. The hub attachment portion and the wall attachment portion may be generally perpendicular to each other. The hub may be positioned on top of the hub attachment portion so that the bracket provides to the hub from the bottom. The article hanging device may be supported by a bracket structure that provides support to the hub from the top, which may be used alone or in combination with another bracket structure (e.g., a bracket structure providing support from the bottom). The bracket structure may be attached to the top (e.g., first side) of the hub at the hub attachment portion, and may be attached to the wall or other support structure at the wall attachment portion. It may be desired that the hub has one or more straight edges so that the hub can be positioned against and secured to the wall.

The one or more bracket structures may instead be attached to and support a post upon which the hub is secured. For example, a bracket structure may support the post underneath the post. Another bracket structure may support the post on top of the post. This arrangement may permit the height of the hub to be adjusted while still having the article hanging device mounted to a wall or another structure. The hub may be secured to the post using any of the means as disclosed herein.

The article hanging device may instead be positioned to hang from a horizontal bar (e.g., a closet rod). The article hanging device may then provide additional storage within a closet. The article hanging device may be secured to a horizontal bar or rod via a rod attachment structure. The rod attachment structure may include a rod interface portion that contacts the rod or horizontal bar. The rod interface portion may be attached to the rod or may clamp around the rod. The rod interface portion may have a shape that generally matches at least a portion of the outer diameter (or other outer surface) of the rod or bar from which the article hanging device is to be secured. The rod attachment structure may then be secured to the hub. The rod attachment structure may have a portion that extends through the central opening of the hub from the first side to the second side and past the second side. The portion that extends through and past the second side of the hub may be a threaded portion. One or more washers or plates having an opening therein may be located on the second side, which may function to provide additional support to the second side of the hub or may function to assist in securing the hub to the rod attachment structure. A nut, such as a wing nut, may be secured to the threaded portion (e.g., to hold the washer or plate in place and/or to secure the hub on the rod attachment structure). The tightening or loosening of the nut on the threaded portion may allow for height adjustment of the hub relative to the rod or bar from which it hangs.

Turning now to the figures, FIG. 1 illustrates an exemplary article hanging device 10, which is adapted for supporting a plurality of articles. The article hanging device 10 includes a hub 30, which is adapted to receive and support a plurality of arms 50. As shown, the arms 50 may be of varying lengths. The arms 50 support one or more attachments 70, which serve to secure the articles on the article hanging device 10.

Figure 2:
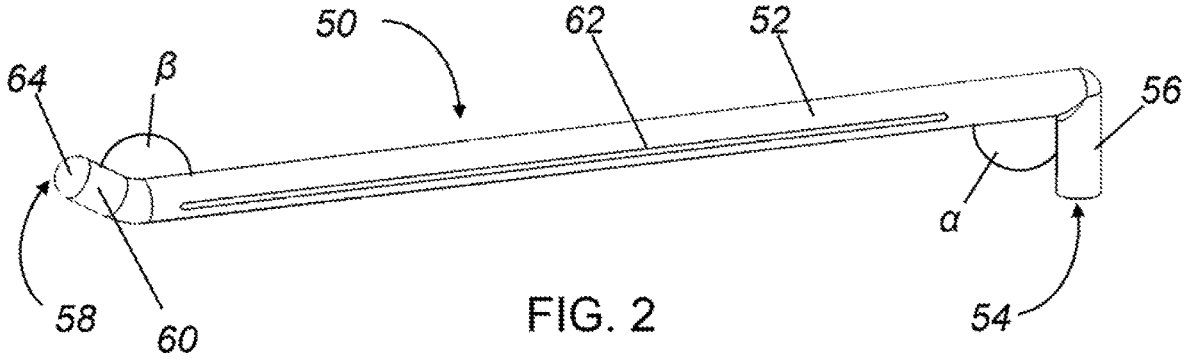
FIG. 2 is a side perspective view of an exemplary arm of an article hanging device in accordance with the present teachings.

FIG. 2 illustrates an exemplary arm 50 of the article hanging device 10. The arm 50 includes a body portion 52 that is located between a proximal segment 56 that terminates at a proximal end 54 and a distal segment 60 that terminates at a distal end 58. The distal end 58 includes a tip 64, which is elastomeric (though tips made of metal, plastic, or other materials are also possible). The proximal end 54 and at least a portion of the proximal segment 56 are adapted to be received within an opening 36 of the hub 30 (see FIGS. 3A and 3B). The proximal segment 56 forms an angle $\alpha$ with the body portion 52. The angle $\alpha$ may generally be a right angle, or be about 90 degrees±10 degrees. When the arm 50 is installed within the hub 30, the distal end 58 extends away from the hub 30. The distal segment 60 of the arm 50 is an upturned portion that forms an angle $\beta$ with the body portion 52. The angle $\beta$ as shown is between 90 degrees and 180 degrees. The upturned portion may create another area upon which an article may be hung or may serve to keep an article from sliding off of the arm. The arm also includes a groove 62, which acts as a guide for securing an attachment 70 (see FIGS. 4A-4C). A lip 76 of the attachment 70 interfaces with and/or engages with the groove 62 to maintain proper position of the attachment 70 on the arm 50. The groove 62 also allows an attachment 70 to slide along the length of the arm 50 so that the attachment is able to be positioned in a desired location on the arm without having to remove the attachment.

Figure 3A:
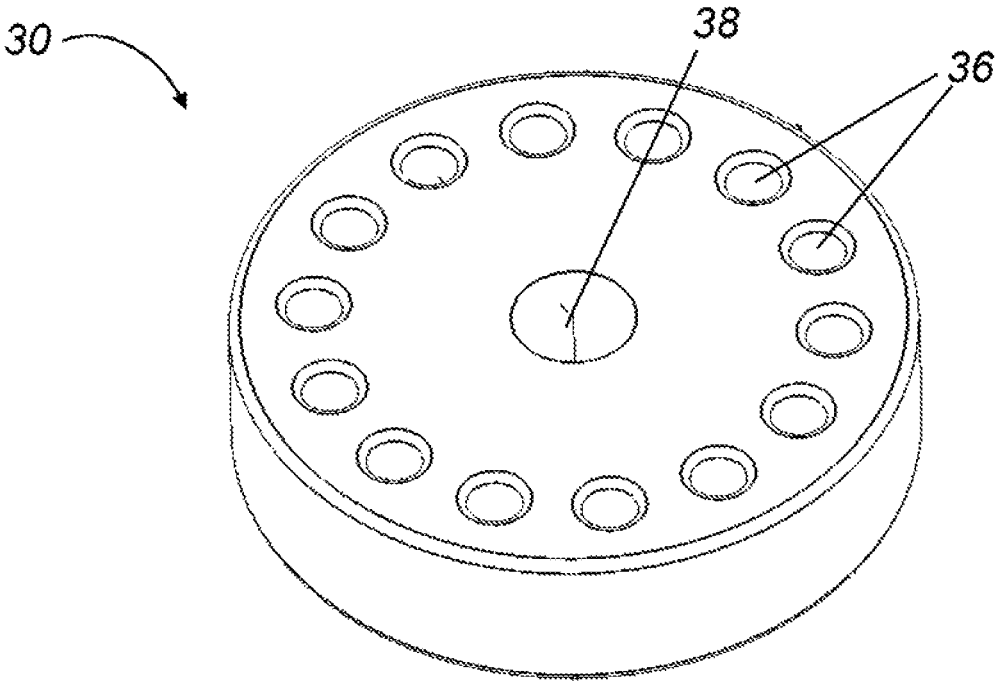
FIG. 3A is a top view of an exemplary hub of an article hanging device in accordance with the present teachings.
Figure 3B:
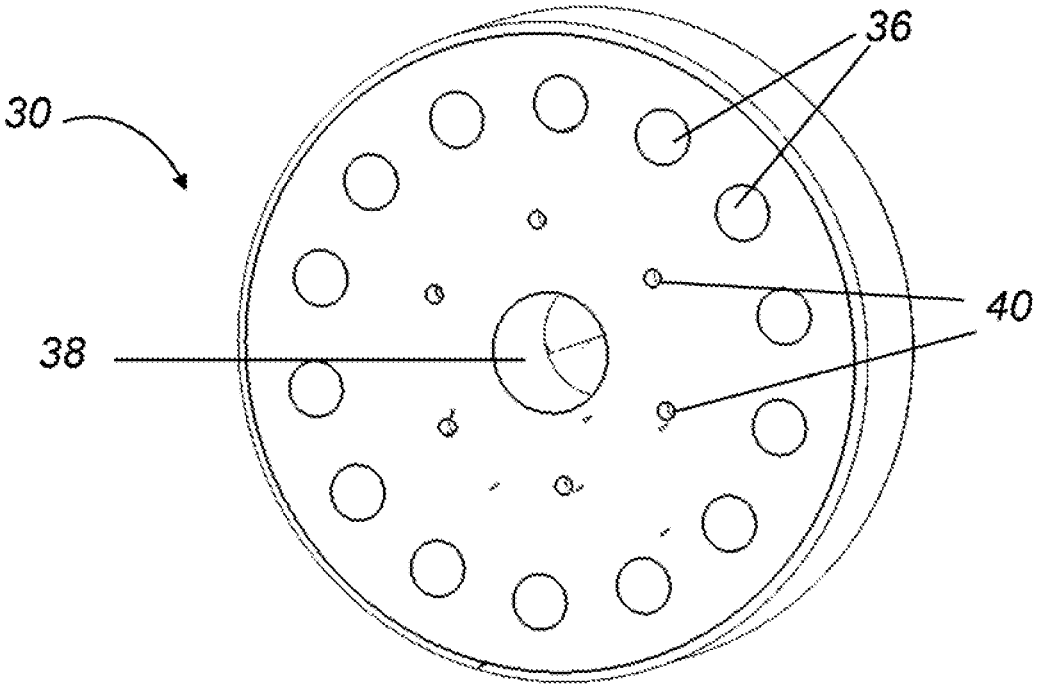
FIG. 3B is a bottom view of an exemplary hub of an article hanging device in accordance with the present teachings.

FIGS. 3A and 3B illustrate an exemplary hub 30 of the article hanging device 10. The hub 30 has a first side 32 (as shown in FIG. 3A) and a second side 34 (as shown in FIG. 3B). The hub 30 includes a plurality of openings 36 for receiving a portion of an arm (e.g., at least the proximal end 54 of the arm 50 of FIG. 2). The hub 30 also includes a central opening 38, which allows the hub to be secured to a post 14 (see FIG. 6) or a rod 104 (see FIG. 10). The second side 34 of the hub 30 also includes a plurality of fastener apertures 40, which also allow the hub 30 to be secured to a post via a post attachment structure 90 (see FIG. 9) or a bracket structure 110 (see FIGS. 11A and 11B).

Figure 4A:
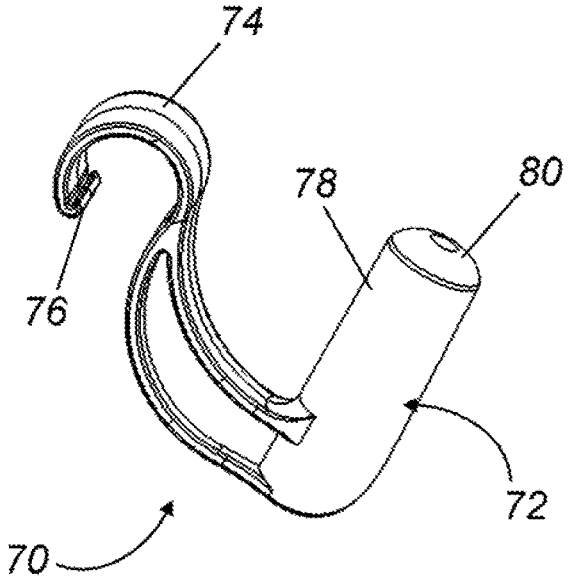
FIGS. 4A, 4B, and 4C are exemplary attachments of the article hanging device in accordance with the present teachings.
Figure 4B:
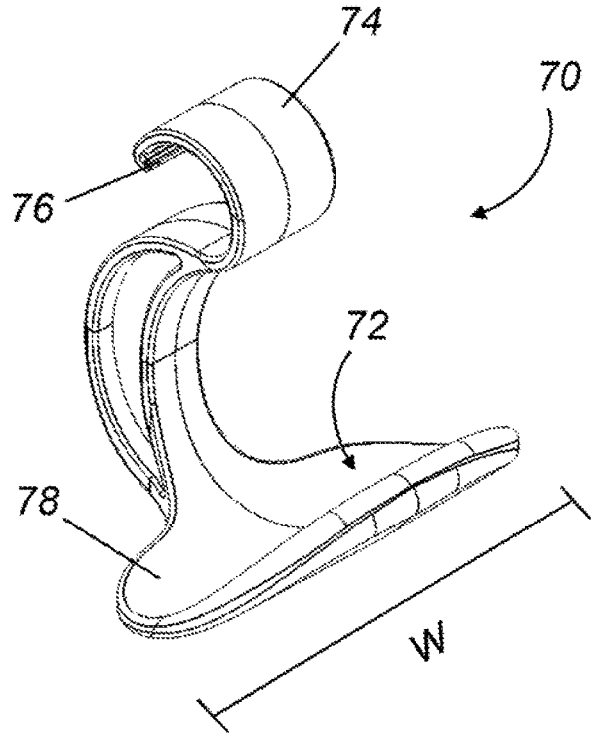
Figure 4C:
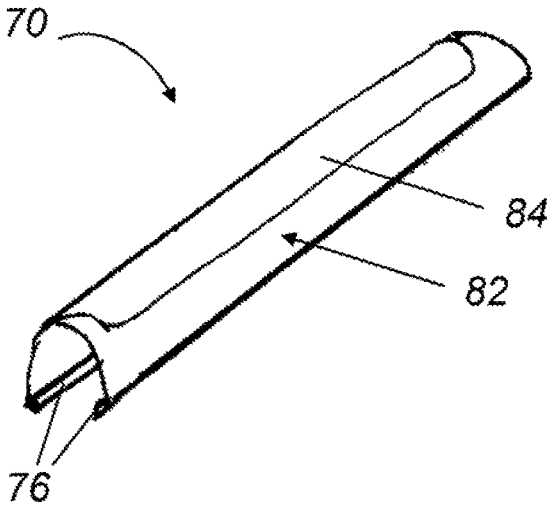
Figure 6:
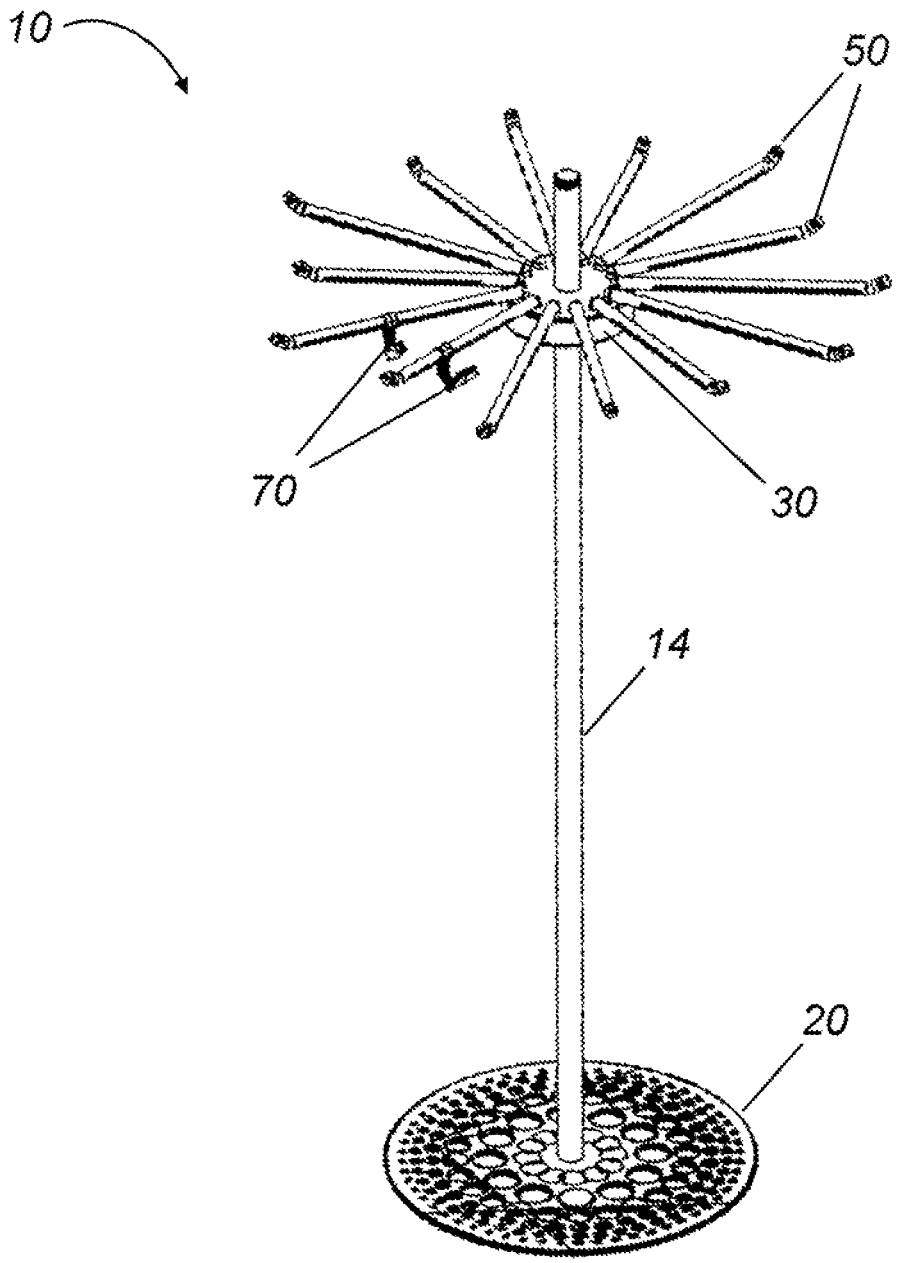
FIG. 6 is a side perspective view of an article hanging device in accordance with the present teachings.
Figure 7:
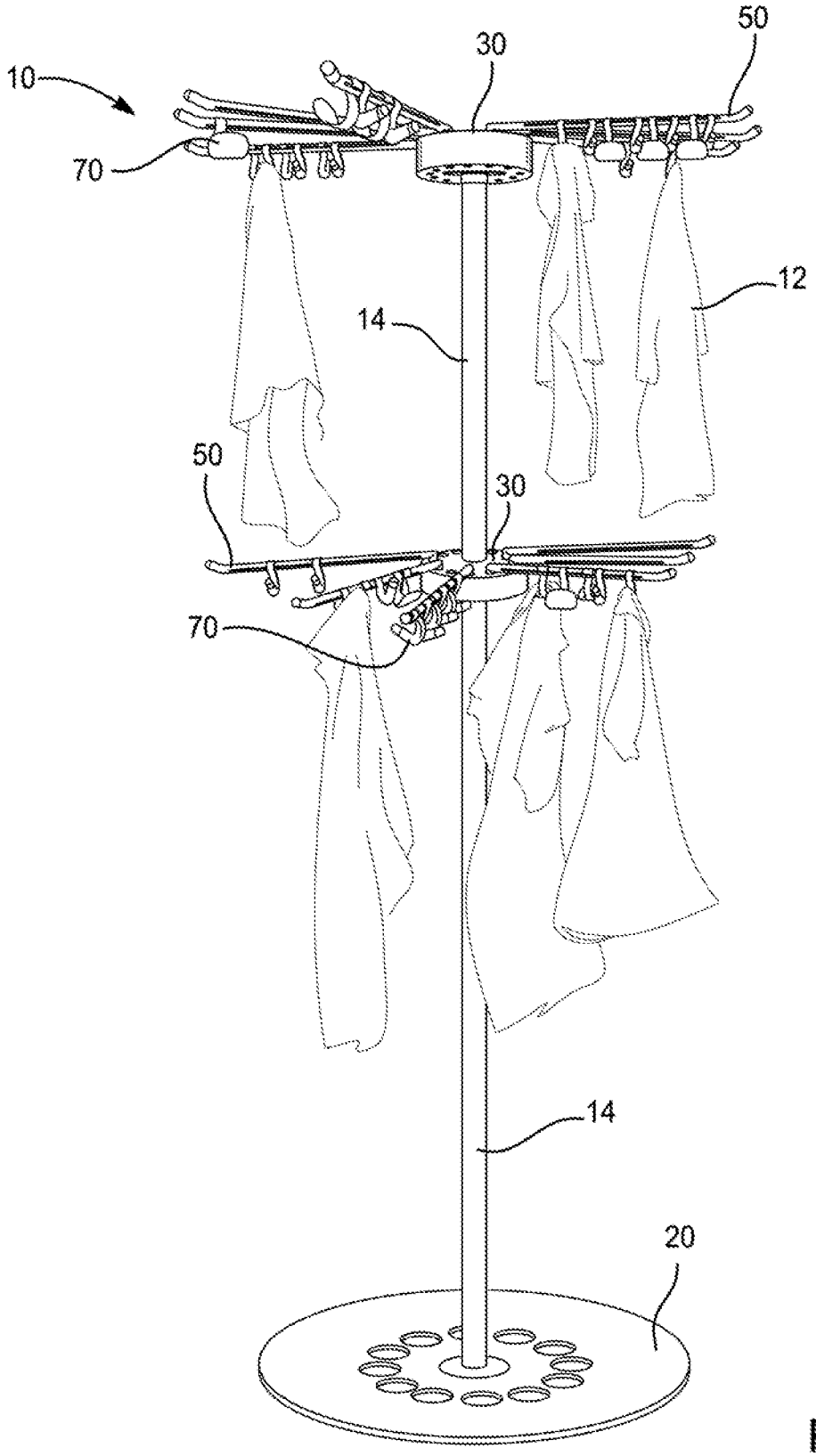
FIG. 7 is a side view of an article hanging device in accordance with the present teachings.

FIGS. 4A, 4B, and 4C illustrate exemplary attachments 70 to be secured to an arm 50 of the article hanging device 10 (see, e.g., FIGS. 6 and 7). FIG. 4A illustrates an attachment 70 having a hook 72 with an article contact portion 78 upon which articles can be hung. The hook 72 terminates at a tip 80, which may be elastomeric or another material that creates a frictional surface to prevent an article from sliding off of the hook 72. On the opposite end of the attachment 70 is a connector portion 74. The inner surface of the connector portion 74 is adapted to contact an arm of the article hanging device and is generally curved to match the surface of the arm to which it is attached. The end of the connector portion 74 includes a lip 76 for engaging with the groove 62 of the arm 50 (see FIG. 2) to maintain the desired position and maintain stability of the attachment 70 on the arm.

FIG. 4B illustrates an attachment 70 having a hook 72 with an article contact portion 78 having a width W. The article contact portion may be the widest part of the attachment 70 to provide a larger surface area upon which an article can be hung, which may allow the attachment to support heavier articles or distribute the pressure on the article from hanging. The article contact portion 78 may be textured or include a frictional surface or coating to prevent an article from sliding off of the hook 72. The attachment 70 includes a connector portion 74, which attaches the attachment 70 to an arm 50 of the article hanging device (see FIG. 2). The inner surface of the connector portion 74 is adapted to contact the arm of the article hanging device and is generally curved to match the surface of the arm to which it is attached. The end of the connector portion 74 includes a lip 76 for engaging with the groove 62 of the arm 50 (see FIG. 2) to maintain the desired position and maintain stability of the attachment on the arm.

FIG. 4C illustrates an attachment 70 serving as a friction member 82. The friction member 82 includes a frictional surface 84, such as a coating or other material layer for enhancing friction between an article and the friction member so that the article does not slide off of the arm. The friction member 82 may be useful for draping articles over an arm of the article hanging device, such as a towel or pants. The friction member 82 includes a lip 76 on opposing edges for engaging with the grooves 62 of an arm 50 and securing the friction member 82 on top of the arm 50 (see FIG. 2).

Figure 5A:
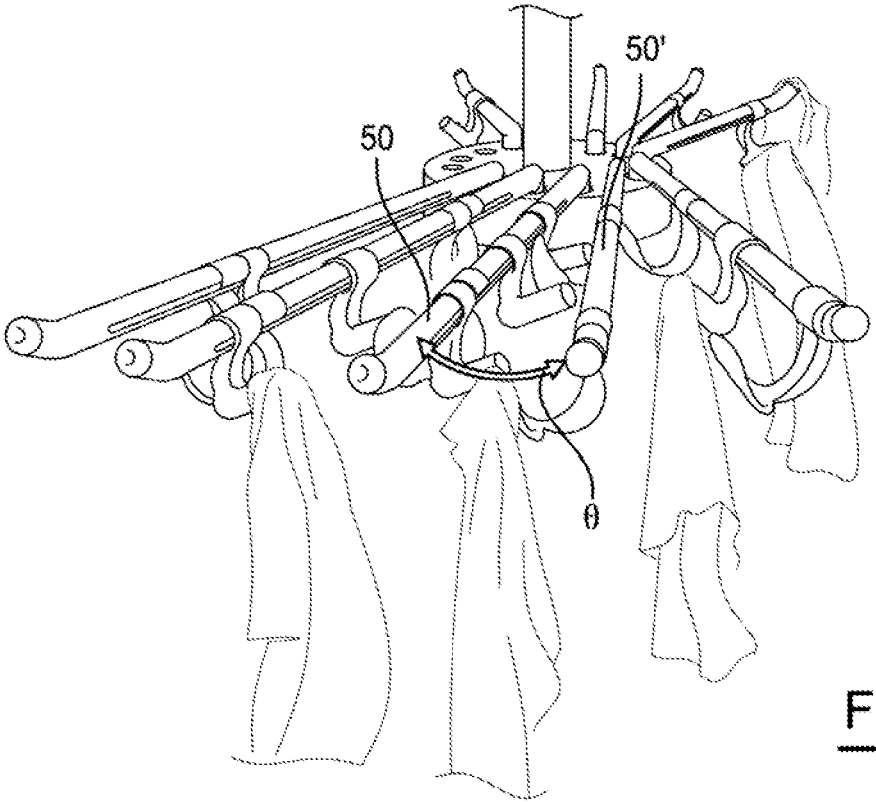
FIGS. 5A and 5B illustrate the ability of the arms of the article hanging device to move relative to each other.
Figure 5B:
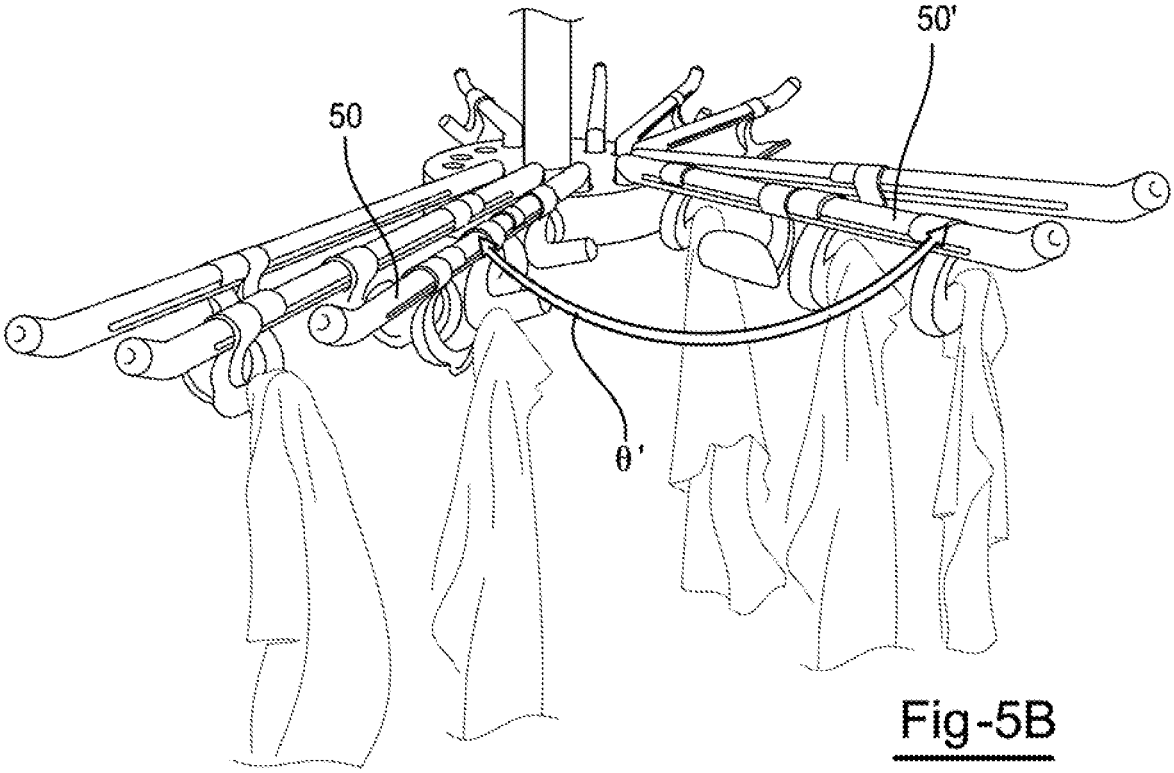

FIGS. 5A and 5B illustrate the ability of the arms of the article hanging device to move relative to each other. The device includes an arm 50 and an adjacent arm 50'. In FIG. 5A, the arms 50 and 50' form an angle $\theta$. In FIG. 5B, the adjacent arm 50' is moved away from the arm 50 so that a larger angle $\theta'$ is formed between the arms 50 and 50'. The ability of the arms to move allows for easier access to articles hanging from the article hanging device.

FIG. 6 illustrates an article hanging device 10 including a post 14 supported in an upright or vertical position by a base 20. A hub 30 is located on the post (e.g., adjustably), and the hub 30 is adapted to receive and support a plurality of arms 50 upon which articles can be hung (e.g., from one or more attachments 70).

FIG. 7 illustrates an exemplary article hanging device 10 having two levels of arms 50, though additional levels are also contemplated. The multi-level arrangement may allow for longer articles to hang (i.e., from a higher level), may accommodate more articles, may make more articles visible at one time, may permit additional organization of articles 12 (e.g., arranging articles by type, such as shirts on the top level and pants on the bottom level), or the like. The article hanging device 10 includes a base 20 supporting a post 14 (or one or more post sections joined together) that extends in a generally vertical direction. Two hubs 30 are secured to the post 14 to create the multi-level arrangement. Each hub 30 has a plurality of arms 50 secured therein and extending therefrom. As shown, articles 12 are able to hang from attachments 70 that are arranged on the arms 50.

Figure 8A:
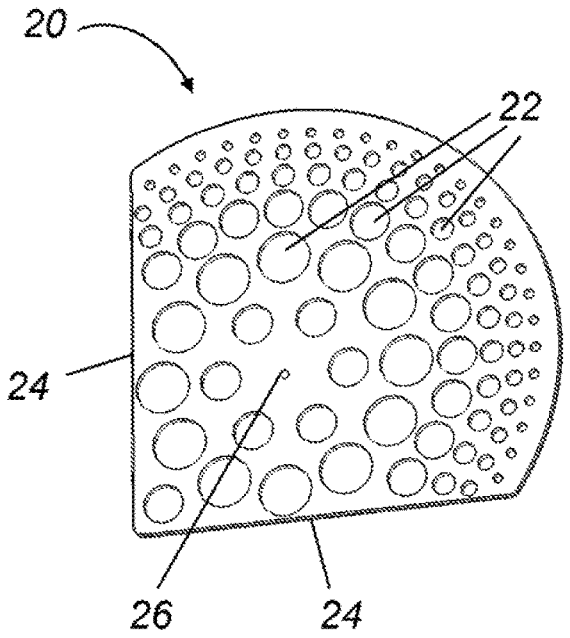
FIGS. 8A, 8B, and 8C are exemplary bases for an article hanging device in accordance with the present teachings.
Figure 8B:
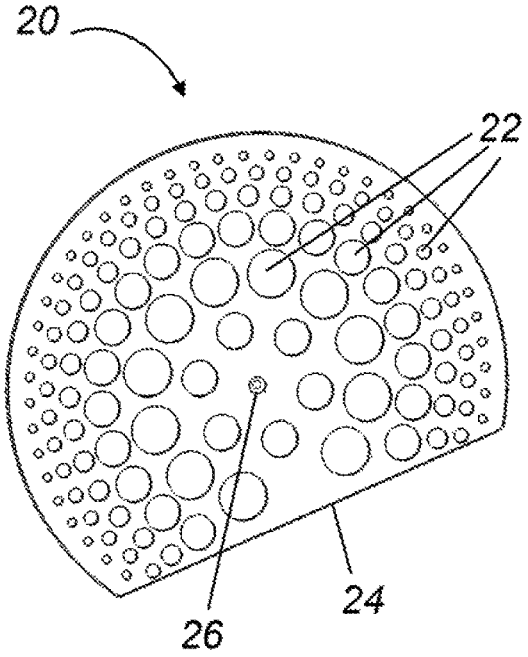
Figure 8C:
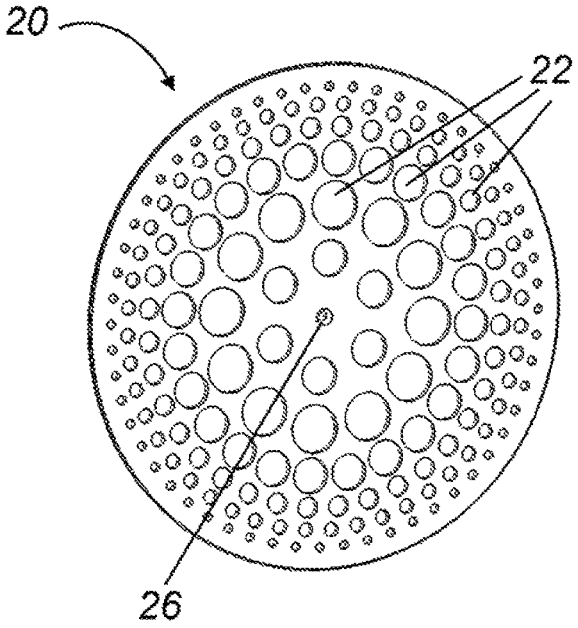

FIGS. 8A, 8B, and 8C illustrate exemplary bases 20 of an article hanging device having a plurality of apertures 22 of varying sizes. The apertures 22 may be arranged in a way that provides stability to the article hanging device, as the smaller apertures 22 are located toward the outer portion of the base, thereby ensuring that increased mass and weight is positioned toward the outer perimeter. The base 20 includes a post attachment area 26, which is adapted to receive a fastener for securing a post to the base (see FIGS. 6 and 7). FIG. 8A illustrates a base 20 with a plurality of apertures 22. The base 20 also includes two generally linear portions 24, which generally intersect to form a 90 degree angle. The shape of the base 20 allows the article hanging device to be positioned in a corner of a room, for example. FIG. 8B illustrates a base 20 with a plurality of apertures 22. The base 20 includes a generally linear portion 24, which allows the article hanging device to be positioned against a straight edge or flat surface, such as a wall. FIG. 8C illustrates a base 20 that is generally circular.

Figure 9:
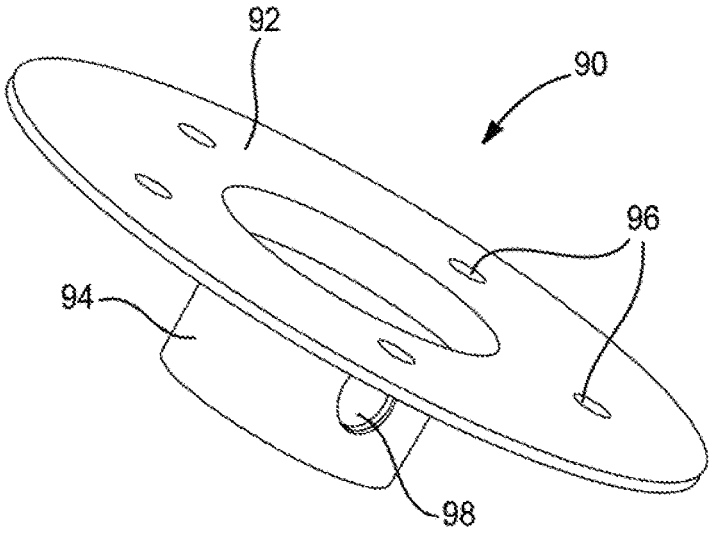
FIG. 9 is an exemplary post attachment structure for an article hanging device in accordance with the present teachings.

FIG. 9 illustrates a post attachment structure 90, which allows the hub 30 (see FIGS. 3A and 3B) to be attached to a post 14 (see FIGS. 6 and 7). The post attachment structure 90 includes a hub interface portion 92, which contacts and is secured to the hub. The post attachment structure 90 further includes a hollow portion 90 that is centrally located and is adapted to align with the central opening 38 of the hub 30 (see FIGS. 3A and 3B) for receiving a post. The hub interface portion 92 includes a plurality of fastener apertures 96, which are adapted to receive fasteners (e.g., screws) for securing the post attachment structure 90 to the hub 30. The fastener apertures 96 may be generally aligned with the fastener apertures 40 located on the second side 34 of the hub 30, as shown in FIG. 3B. The hollow portion 94 includes one or more position securing openings 98, adapted for receiving a fastener or other securing member to secure the post attachment structure 90 (and the hub 30) on the post. For example, the position securing opening 98 may be threaded to receive a screw or bolt, where the screw or bolt is tightened until it contacts the post and prevents any further movement of the position attachment structure 90. In another example, though not limiting, the post may include one or more openings that generally align with the position securing opening 98 so that a pin may be inserted into the openings to hold the post attachment structure 90 and hub 30 in place.

Figure 10:
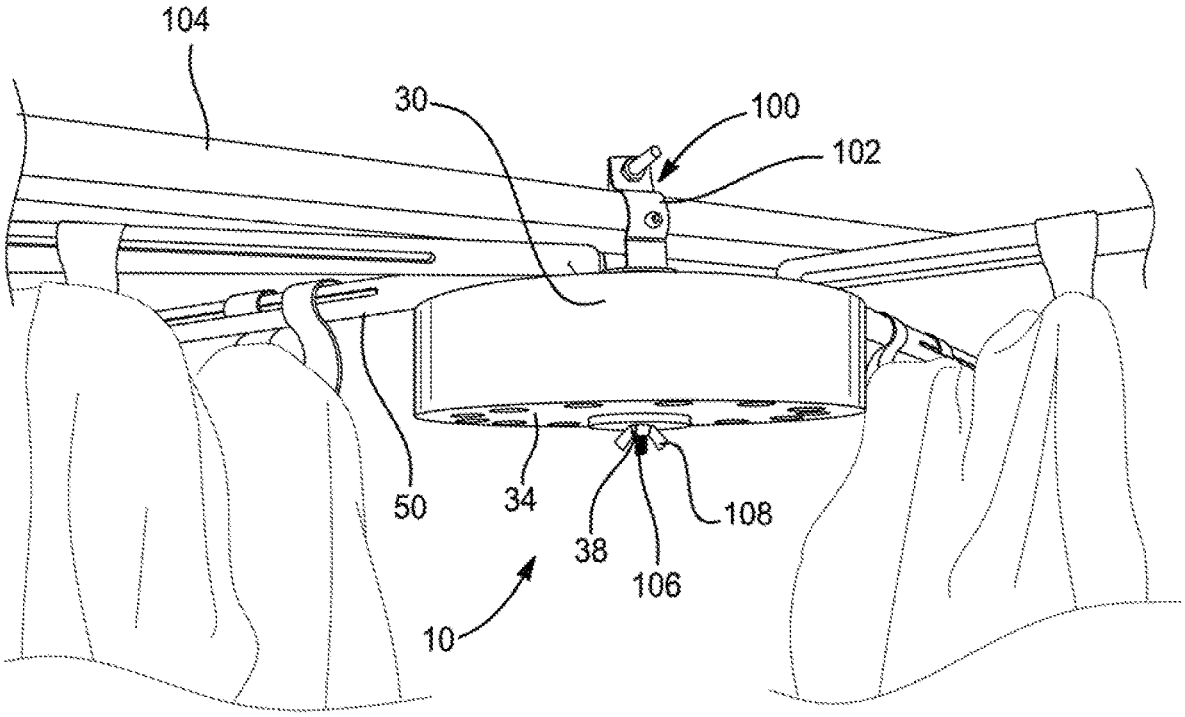
FIG. 10 is a side view of an article hanging device attached to a horizontal rod in accordance with the present teachings.

FIG. 10 illustrates an article hanging device 10 installed on a rod 104, shown as a horizontal closet rod. The article hanging device 10 is attached to the rod 104 by a rod attachment structure 100. The rod attachment structure 100 includes a rod interface portion 102 that contacts the rod 104 (e.g., may clamp onto the rod or may be screwed onto the rod). A portion of the rod attachment structure 100 extends through the central opening 38 of the hub 30. As an example, the rod attachment structure 100 includes a threaded portion 106 that extends through the central opening 38 and extends past the second side 34 of the hub 30. A nut 108, shown as a wing nut, is secured on to the threaded portion 106 to hold the hub 30. The extent to which the nut 108 is tightened may permit a height adjustment of the hub relative to the rod 104. Preferably, the hub 30 is held in a position on the rod 104 that still allows for movement of the arms 50 relative to each other.

Figure 11A:
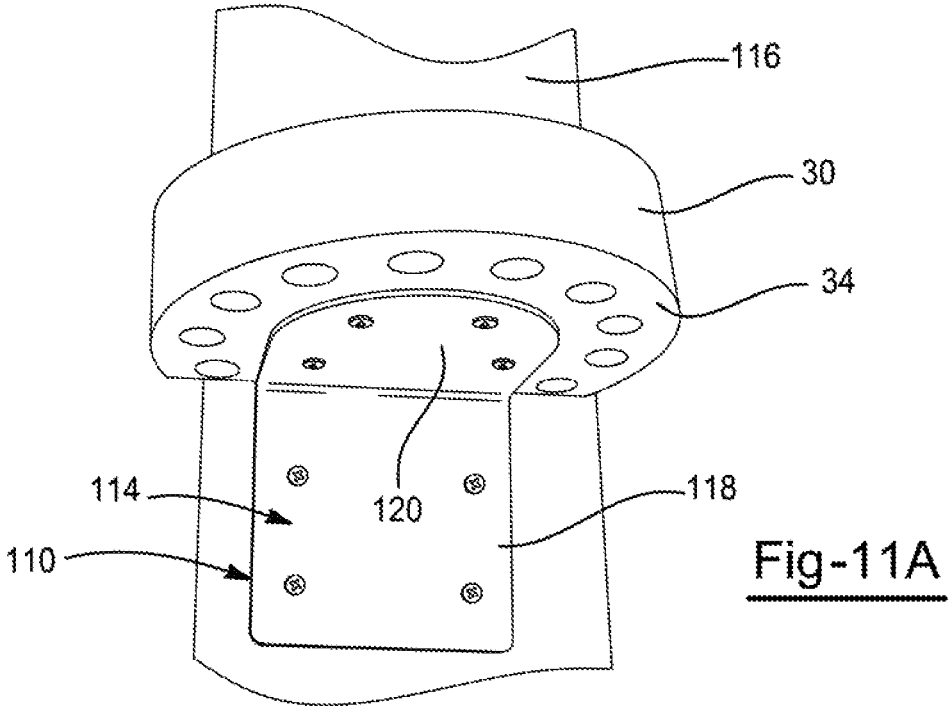
FIG. 11A is a bottom view of an exemplary hub of an article hanging device and a bracket structure in accordance with the present teachings.
Figure 11B:
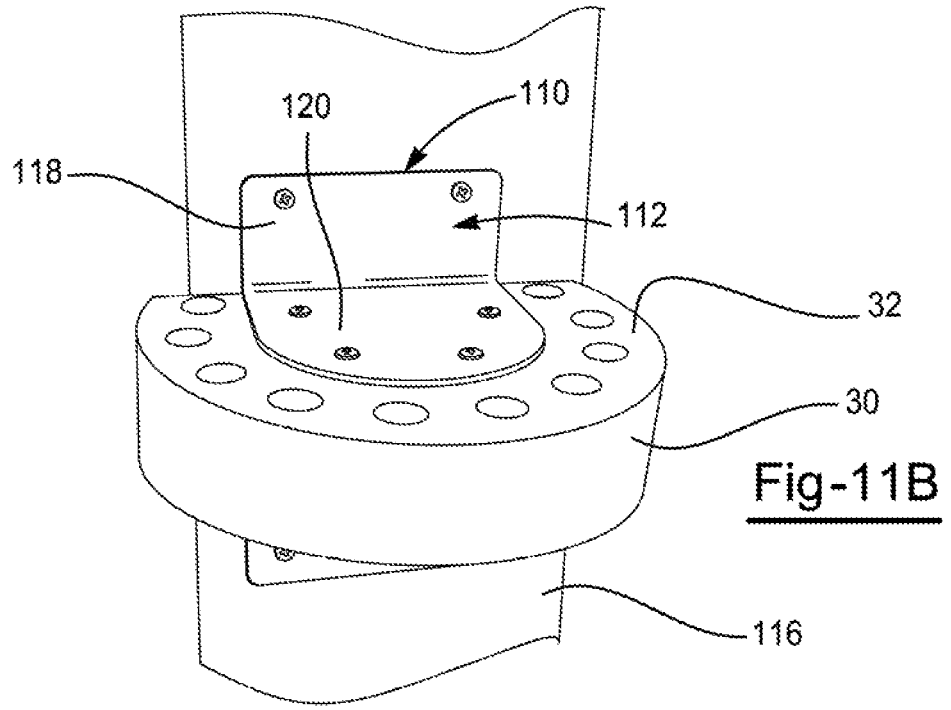
FIG. 11B is a top view of an exemplary hub of an article hanging device and a bracket structure in accordance with the present teachings.

FIGS. 11A and 11B illustrate a wall-mounted article hanging device (with arms and attachments omitted for clarity). The hub 30 is semicircular, with a flat portion adapted to be held against a wall 116. The hub 30 is supported by one or more bracket structures 110 having a wall attachment portion 118 and a hub attachment portion 120. The wall attachment portion 118 is adapted to be secured to a wall 116 (e.g., via a fastener or adhesive). The hub attachment portion 120 is adapted to be secured to the hub 30 (e.g., via a fastener or adhesive). Fasteners for attaching the hub attachment portion 120 to the hub 30 may be received within the fastener apertures 40 of the hub 30 (see FIG. 3B). FIG. 11A illustrates a bracket structure 110 located below the hub 30 so that the hub attachment portion 120 is attached to the second side 34 of the hub 30 and provides support from the bottom. The bracket structure 110 of FIG. 11A can be used alone, or in combination with the bracket structure 110 as shown in FIG. 11B (or they may be an integral structure adapted to have hub attachment portions 120 that contact both the first side 32 and the second side 34 of the hub 30). The bracket structure of FIG. 11B is located above the hub 30 to provide support from the top. The hub attachment portion 120 is thereby attached to the first side 32 of the hub.

Figure 12:
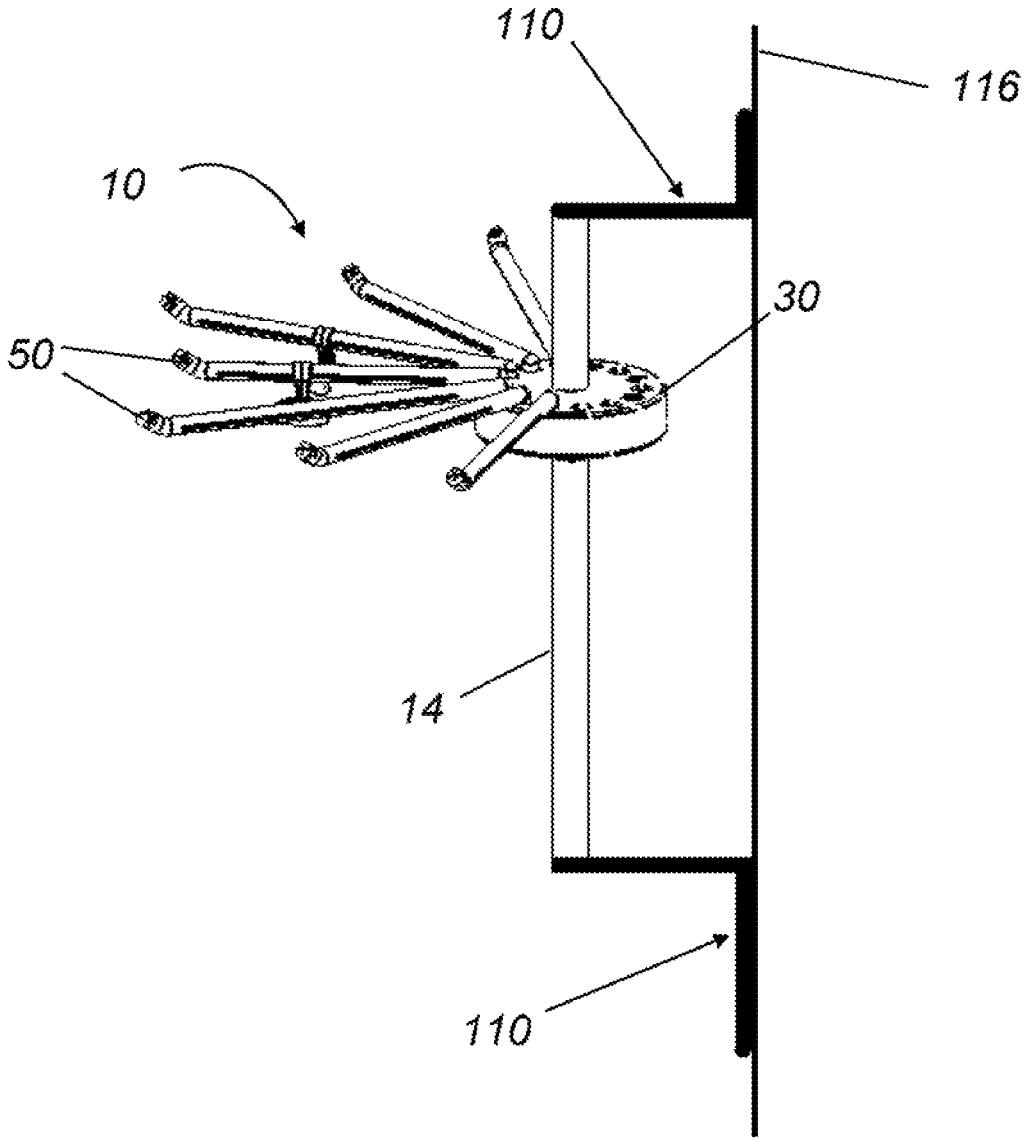
FIG. 12 is a side view of an article hanging device in accordance with the present teachings.

FIG. 12 illustrates a wall-mounted article hanging device 10. The article hanging, device 10 is mounted to a wall 116 via two bracket structures 110. The bracket structures 110 support a post 14, upon which a hub 30 is secured. The hub 30 is adapted to receive a plurality of arms 50, which are capable of supporting articles that hang therefrom. The height of the hub 30 can be adjusted on the post 14 (e.g., with the post attachment structure as shown in FIG. 9).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

As can be appreciated, variations in the above teachings may be employed. For example, it may be possible to employ a plurality of openings in the portion of the hub between the first side and the second side with the arms extending outwardly (e.g., spokes extending from the hub). In such case, it may not be necessary to have an angle between the body portion and the distal segment of the arm. It may be possible to position the hub on top of a post (e.g., so the hub acts a cap), in which case, the hollow opening in the hub may not extend through the entire thickness of the hub. The present teachings contemplate any type of bracket structure for attaching the article hanging device to a structure, such as a wall. The present teachings also contemplate any type of structure that is attached to the hub for allowing the hub to be hung from a horizontal rod or bar.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of, or even consisting of, the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

Relative positional relationships of elements depicted in the drawings are part of the teachings herein, even if not verbally described. Further, geometries shown in the drawings (though not intended to be limiting) are also within the scope of the teachings, even if not verbally described.

What is claimed is:

1. An article hanging device comprising:

a. a hub having a first side and an opposing second side, the first side having a plurality of openings; and b. a plurality of arms, each arm having a body portion located between a proximal end and a distal end, c. one or more attachments secured to at least one of the arms, the one or more attachments including a connector portion for securing the one or more attachments to the at least one arm;

wherein one or more of the arms includes one or more grooves that extend along at least a portion of a length of the arm;

wherein the connector portion of the one or more attachments includes a feature that interfaces with the groove to secure the one or more attachments on the arm;

wherein at least one of the one or more attachments generally forms an S-shape, wherein the S-shape includes the connector portion for securing the attachment to the arm and a hook portion adapted for contacting the one or more articles supported by the article hanging device;

wherein the proximal end of each arm is received within one of the openings of the hub and wherein the arm is in pivoting relation to the openings, and wherein the plurality of arms and/or the one or more attachments are adapted to support one or more articles.

2. The article hanging device of claim 1, wherein at least one of the one or more attachments includes a hook portion that terminates at a tip for supporting the article and/or allowing the article to be hung therefrom.

3. The article hanging device of claim 1, wherein at least one of the one or more attachments includes a hook portion that has a width that is greater than any other portion of the one or more attachments.

4. The article hanging device of claim 1, wherein at least one of the one or more attachments is adapted to snap onto one of the arms of the article hanging device.

5. The article hanging device of claim 1, wherein the feature that interfaces with the groove is a lip.

6. The article hanging device of claim 1, wherein at least one of the one or more attachments includes a frictional surface or frictional coating in an area where the one or more articles are adapted to contact the at least one of the one or more attachments.

7. The article hanging device of claim 1, wherein the hub is adapted to be mounted to a structure via one or more bracket structures.

8. The article hanging device of claim 1, wherein the hub includes a hollow portion.

9. The article hanging device of claim 8, comprising a post received within the hollow portion of the hub, wherein the hub is secured to the post at a desired position.

10. The article hanging device of claim 9, comprising a base for stabilizing the article hanging device, wherein the post is secured to and extends from the base.

11. The article hanging device of claim 9, wherein the post is mounted to a structure via one or more bracket structures.

12. The article hanging device of claim 9, wherein the position of the hub on the post can be adjusted.

13. The article hanging device of claim 9, wherein the article hanging device includes two or more hubs secured to the post.

14. The article hanging device of claim 1, wherein the article hanging device is secured to and hung from a horizontal rod via a rod attachment structure.

15. The article hanging device of claim 1, wherein the hub is generally circular.

16. The article hanging device of claim 1, wherein the hub is shaped to have one or more straight edges.

17. The article hanging device of claim 1, wherein the plurality of openings in the hub are arranged at or near an entire perimeter of the hub.

18. The article hanging device of claim 1, wherein the plurality of openings in the hub are arranged at or near only a portion of a perimeter of the hub.

19. The article hanging device of claim 1, wherein the distal end of one or more of the arms is at an angle relative to the body portion.

20. The article hanging device of claim 1, wherein at least one of the one or more attachments are removable and adjustable.

* * * * *